US008231244B2

(12) United States Patent
He et al.

(10) Patent No.: US 8,231,244 B2
(45) Date of Patent: Jul. 31, 2012

(54) LATERAL REFLECTOR

(75) Inventors: Xi Yuan He, Shenzhen (CN); Yabin Luo, Shenzhen (CN); Chin You Yue, Wan Chai (HK)

(73) Assignee: Osram AG, Munich (DE)

( * ) Notice: Subject to any disclaimer, the term of this patent is extended or adjusted under 35 U.S.C. 154(b) by 290 days.

(21) Appl. No.: 12/651,505

(22) Filed: Jan. 4, 2010

(65) Prior Publication Data

US 2010/0182787 A1 Jul. 22, 2010

(30) Foreign Application Priority Data

Jan. 16, 2009 (CN) ..... 2009 1 0001293

(51) Int. Cl.
*F21V 7/04* (2006.01)

(52) U.S. Cl. ..... 362/241; 362/298

(58) Field of Classification Search ..... 362/241, 362/296.01, 297, 298, 341, 342, 346, 347, 362/349
See application file for complete search history.

(56) References Cited

U.S. PATENT DOCUMENTS 5,390,095 A * 2/1995 Lemons et al. ..... 362/301
2011/0063848 A1* 3/2011 Rong et al. ..... 362/294

* cited by examiner

*Primary Examiner* — David V Bruce

(57) ABSTRACT

Various embodiments provide a lateral reflector, wherein the lateral reflector has a bottom opening, a light source arranged on a base plate can be accommodated in the bottom opening; a reflecting surface is arranged on two opposite sides of the light source in the lateral reflector, and the reflecting surface is configured to reflect a light emitted from the light source and arriving at the reflecting surface, so that the light arriving at the reflecting surface is deflected toward a direction that is parallel to the opposite sides. Various embodiments further provide an array of such lateral reflectors. Further, various embodiments disclose a lamp unit and a lamp containing such lateral reflector, and puts forward a method for producing such lateral reflector.

11 Claims, 7 Drawing Sheets

LATERAL REFLECTOR

CROSS-REFERENCE TO RELATED APPLICATION

This application claims priority to Chinese Patent Application No. 200910001293.4, which was filed Jan. 16, 2009, and is incorporated herein by reference in its entirety.

TECHNICAL FIELD

Various embodiments relate to a lateral reflector, and e.g., to a lateral reflector applied in the general illumination, and e.g., to a lateral reflector applied in the street lamp.

BACKGROUND

In a normal lamp, a light source such as light-emitting diode (LED) is generally arranged in a reflecting cup, so as to shape the light emitted from the light source, and/or a lens is used for shaping. For example, FIG. 1 shows a solution in the prior art. In this solution, light sources 1 are arranged in bowls 2. The surfaces of the bowls are coated with a reflective material to function as reflecting mirrors, so that the light output from the light source 1 is nearly a parallel light. An optical lens 3 is arranged over the bowls 2. With the optical lens 3, the angle of the output light may be adjusted to satisfy application requirements. However, because the optical lens which is usually made of resin is used, the lens tends to age in the case of a high power light source, and the service life of the lamp may be shortened. If a lens made of glass is used, the cost in the production technology may be high on one hand, and the lamp may easily be damaged on the other hand. If the power of the light source is reduced to ensure the service life of the lamp, the brightness required by the application may not be satisfied.

SUMMARY

Various embodiments provide a lateral reflector. With this reflector, the light emitted by the light source may be shaped in a defined manner, and a long service life and high efficiency of the lamp as well as a better homogeneity of the light spot may be achieved.

According to various embodiments, a lateral reflector is provided, wherein the lateral reflector has a bottom opening, a light source arranged on a base plate can be accommodated in the bottom opening; a reflecting surface is arranged respectively on two opposite sides of the light source in the lateral reflector, and the reflecting surface is configured to reflect a light emitted from the light source and arriving at the reflecting surface, so that the light arriving at the reflecting surface is deflected toward a direction that is parallel to the opposite sides.

Further, various embodiments provide a lamp unit, including a base plate, a light source arranged on the base plate, and an aforementioned lateral reflector. The lateral reflector is configured so that the light source on the base plate is accommodated in a bottom opening of the lateral reflector.

Further, various embodiments provide a lamp, which includes a plurality of aforementioned lamp units arranged in an array.

According to various embodiments, it is provided a method for producing the lateral reflector, including: arranging a reflecting surface on opposite sides of a light source respectively, wherein the reflecting surface is configured to reflect a light emitted from the light source and arriving at the reflecting surface, so that the light arriving at the reflecting surface is deflected toward a direction that is parallel to the opposite sides.

In the case of the lateral reflector according to various embodiments, due to the special construction of the reflecting surface, the light emitted from the light source may be shaped as the form required, and the intensity distribution of the light spot may be more homogeneous. Furthermore, in the lamp according to various embodiments, because no lens is required, a long service life and high efficiency of the lamp may be achieved.

BRIEF DESCRIPTION OF THE DRAWINGS

Various embodiments may be better understood by referring to the description hereinafter in combination with the drawings. All the drawings and the detailed description are included in the specification and constitute a part of the specification, and are used to further present examples to illustrate various embodiments and explain the principles and advantages of various embodiments. Wherein.

Figure 1:
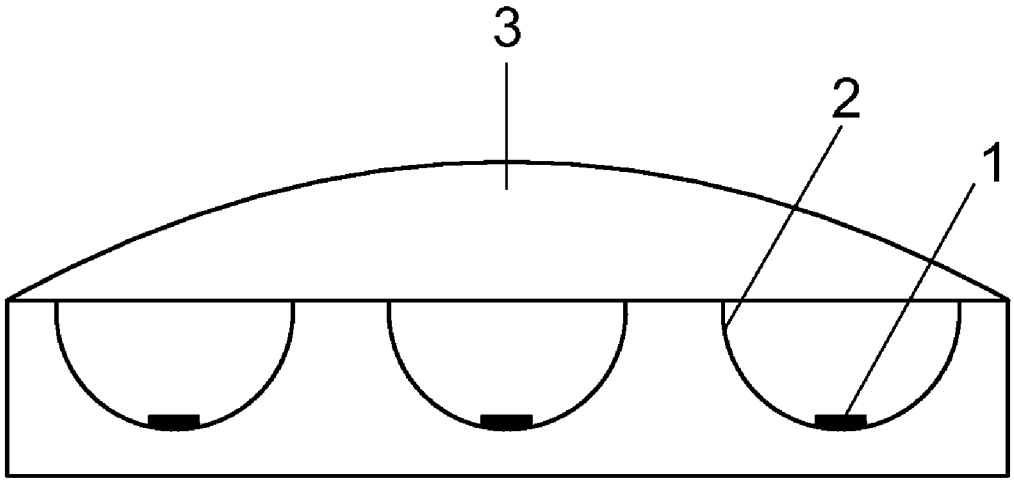
FIG. 1 shows a lamp in the prior art.

In above drawings, the components that are the same or have the same function have the same reference signs. The elements illustrated as well as the size thereof should not be regarded as in proportion. To be precise, for a clearer and/or better understanding, the individual elements can be illustrated in an exaggerated and/or deformed manner.

DETAILED DESCRIPTION

Hereinafter, various embodiments will be described in combination with the drawings. In view of clearness and conciseness, not all the features of the practical embodiments are described in the description. However, it should be understood that many decisions specific to the embodiments need to be made during the development of any practical embodiments, so as to achieve the specific objects of the developer, and these decisions may vary to some extent according to different embodiments. Further, it should be understood that although the developing work may be rather complicated and time-consuming, it is only a routine job for those skilled in the art who benefit from the disclosure of the present invention.

It should be further pointed out here that in the drawings, only the device structure closely related to the solution of various embodiments is illustrated in the drawings, and other details having little relation with the various embodiments is omitted, so as to avoid making the various embodiments unclear due to unnecessary details.

The embodiments provide a lateral reflector. With this reflector, the light emitted by a light source may be shaped in a defined manner, and a long service life and high efficiency of the lamp may be achieved.

Figure 2:
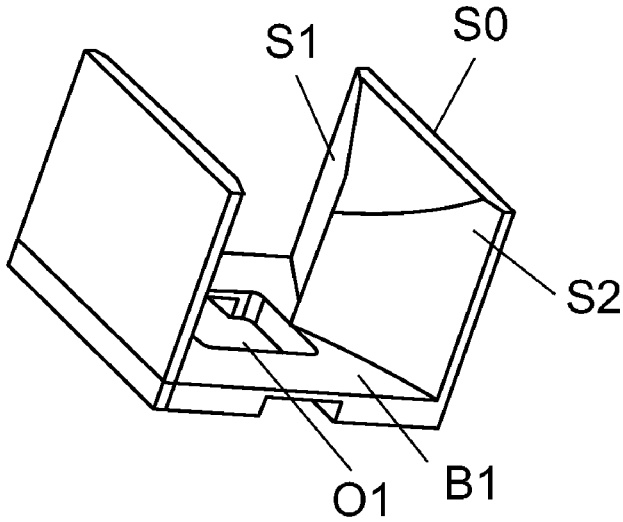
FIG. 2 is a perspective view of a lateral reflector according to an embodiment.

FIG. 2 is a perspective view of the lateral reflector according to an embodiment. It can be clearly seen from FIG. 2 that the lateral reflector has a bottom opening O1, a light source arranged on a base plate can be accommodated in the bottom opening O1. Mirror symmetrical reflecting surfaces are arranged on two opposite sides S0 of the lateral reflector. The reflecting surfaces may include or consist of two facets S1 and S2 respectively. S1 and S2 are approximate planes and perpendicular to the bottom B1 of the lateral reflector. Due to such special structure of the reflecting surfaces S1 and S2 which is different to that of the traditional reflecting cup, when the light from the light source accommodated in the bottom opening O1 arrives at the reflecting surfaces S1 and S2, the reflecting surfaces do not deflect such incident light to the direction perpendicular to the bottom B1, i.e., the direction of the optical axis of the lateral reflector. Instead, the reflecting surfaces reflect the incident light in a lateral direction, so that the incident light is deflected toward the direction parallel to the opposite sides S0. In this way, the light intensity distribution projected onto the surface to be illuminated becomes more homogeneous, and a required light spot shape may be obtained.

In FIG. 2, it can be also seen that a portion is truncated on the top of the reflecting surfaces S1 and S2. Because of such design, it is avoided that a shadow may appear on the surface to be illuminated due to the shading of the reflecting surfaces S1 and S2, and thus the light intensity distribution projected onto the surface to be illuminated becomes more homogeneous.

Figure 3:
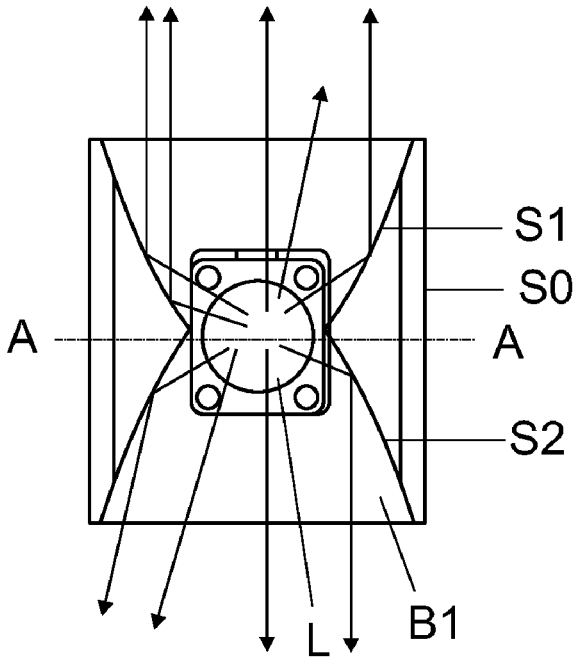
FIG. 3 is a top view of the lateral reflector shown in FIG. 2.

FIG. 3 is a top view of the lateral reflector shown in FIG. 2. It can be clearly seen in FIG. 3 that the reflecting surfaces on the left and right side are mirror symmetrical. However, it should be noted that the reflecting surfaces may also be designed to be non mirror symmetrical according to the requirements of the practical application. A light source L (here: LED) and the optical pathway thereof are illustrated in FIG. 3 for a better understanding of the various embodiments. The lines with arrowheads in FIG. 3 schematically illustrate the light emitted by the LED. It can be seen from FIG. 3 that after the reflection on the reflecting surfaces S1 and S2, the light emitted by the LED is deflected toward the direction parallel to the aforementioned opposite sides S0. This character is particularly advantageous for some illumination applications, especially for the street illumination application, because the light intensity thus may be distributed along the direction of the street.

Figure 4:
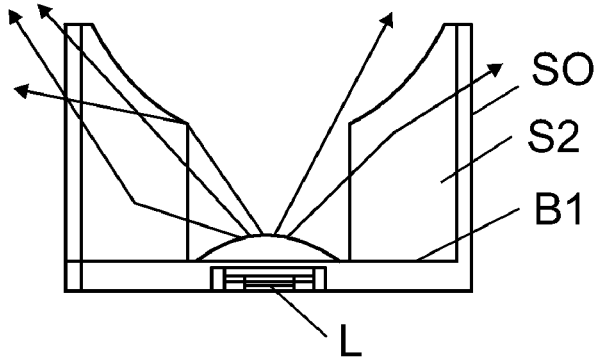
FIG. 4 is a longitudinal section view along the section line AA shown in FIG. 3 of the lateral reflector.

FIG. 4 is a longitudinal section view along the section line AA shown in FIG. 3 of the lateral reflector. It can be seen in FIG. 4 that a portion is truncated on the top of the reflecting surface S2, it is thus avoided that a shadow may appear on the surface to be illuminated due to the shading of this portion. Further, it is schematically illustrated in FIG. 4 the optical pathway of the light emitted by the light source.

In the configuration of the lateral reflector shown in FIG. 2 and FIG. 4, the reflecting surfaces S1 and S2 may be made of metal or plastic cement. In any case, the reflecting surface should have a high reflectivity. The reflecting surface may be designed as required. For example, the reflecting surface may be a smooth surface, or may be a surface with micro-structures, which is familiar to those skilled in the art.

Further, it should be noted that in the above solutions, two reflecting surfaces S1 and S2 are included on one side. These two reflecting surfaces may be designed to be planes or free-form surfaces. The design of the free-form surfaces may be adjusted according to the required illumination intensity distribution of the surface to be illuminated. For example, according to the requirements, the side surfaces may be selected to have a form of paraboloid or hyperboloid. It should be further noted that according to the requirements, the two reflecting surfaces S1 and S2 may also be designed to be a continuous smooth surface. In other words, there may actually exist only one continuous reflecting surface on one side.

Further, the reflecting surfaces S1 and S2 are not necessarily required to be perpendicular to the bottom B1, but may be varied according to requirements.

Figure 5:
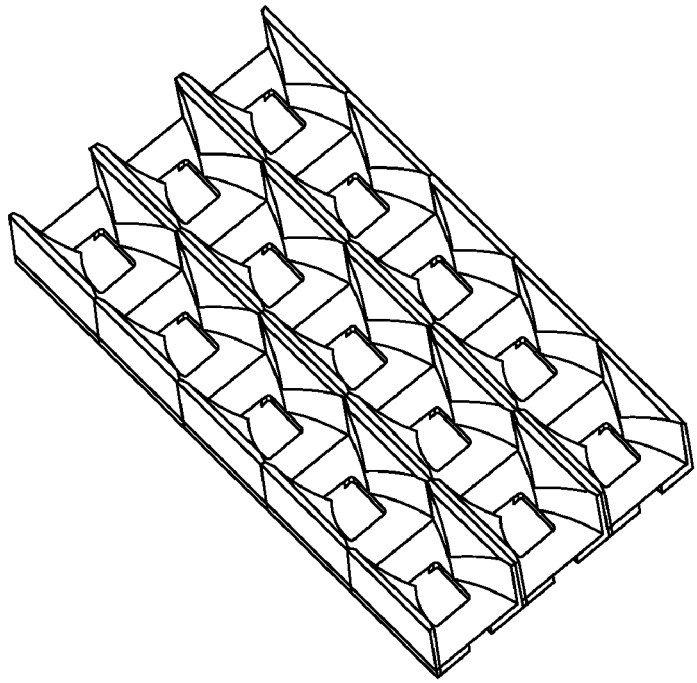
FIG. 5 is a top view of an array consisting of a plurality of lateral reflectors shown in FIG. 2.

According to another embodiment, it is presented a lateral reflector array. FIG. 5 is a perspective view of such array. It can be seen from the drawing that such lateral reflector array is an array made up of a plurality of the lateral reflectors according to the above embodiments. In FIG. 5, these lateral reflectors are arranged to be a rectangular array. Apparently, they may also be arranged in other forms according to the illumination requirements.

According to another embodiment, it is presented a lamp unit, including a base plate, a light source arranged on the base plate and an aforementioned lateral reflector, wherein the lateral reflector is arranged so that the light source arranged on the base plate is accommodated in the bottom opening of the lateral reflector.

Figure 6:
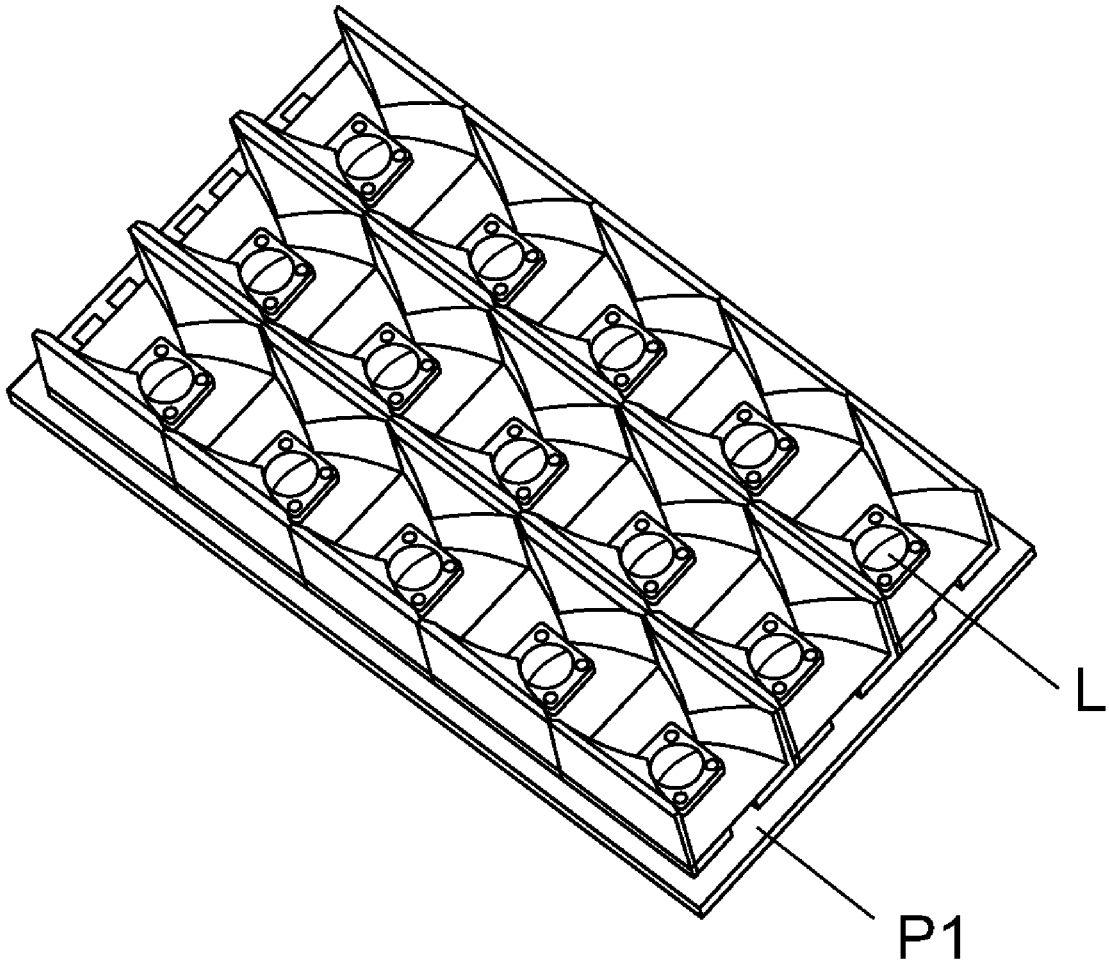
FIG. 6 is a perspective view of the lateral reflector with LED light sources mounted on a printed circuit board (PCB)

FIG. 6 is a perspective view of a lamp. This lamp is made up of a plurality of aforementioned lamp units arranged in an array. The lamp includes: a PCB P1; a plurality of light sources arranged on the PCB P1, especially LEDs; and an array constituted by the lateral reflectors. An LED is arranged in the bottom opening of each lateral reflector. In the solution shown in FIG. 6, the lamp units are arranged as a rectangle. On the basis of the operating principle of the lateral reflector and such arrangement, a homogeneous rectangular light spot may be realized effectively, which is particularly suitable for the street illumination. Certainly, the lamp units may also be arranged in other modes, so as to satisfy the corresponding illumination requirements.

Figure 7:
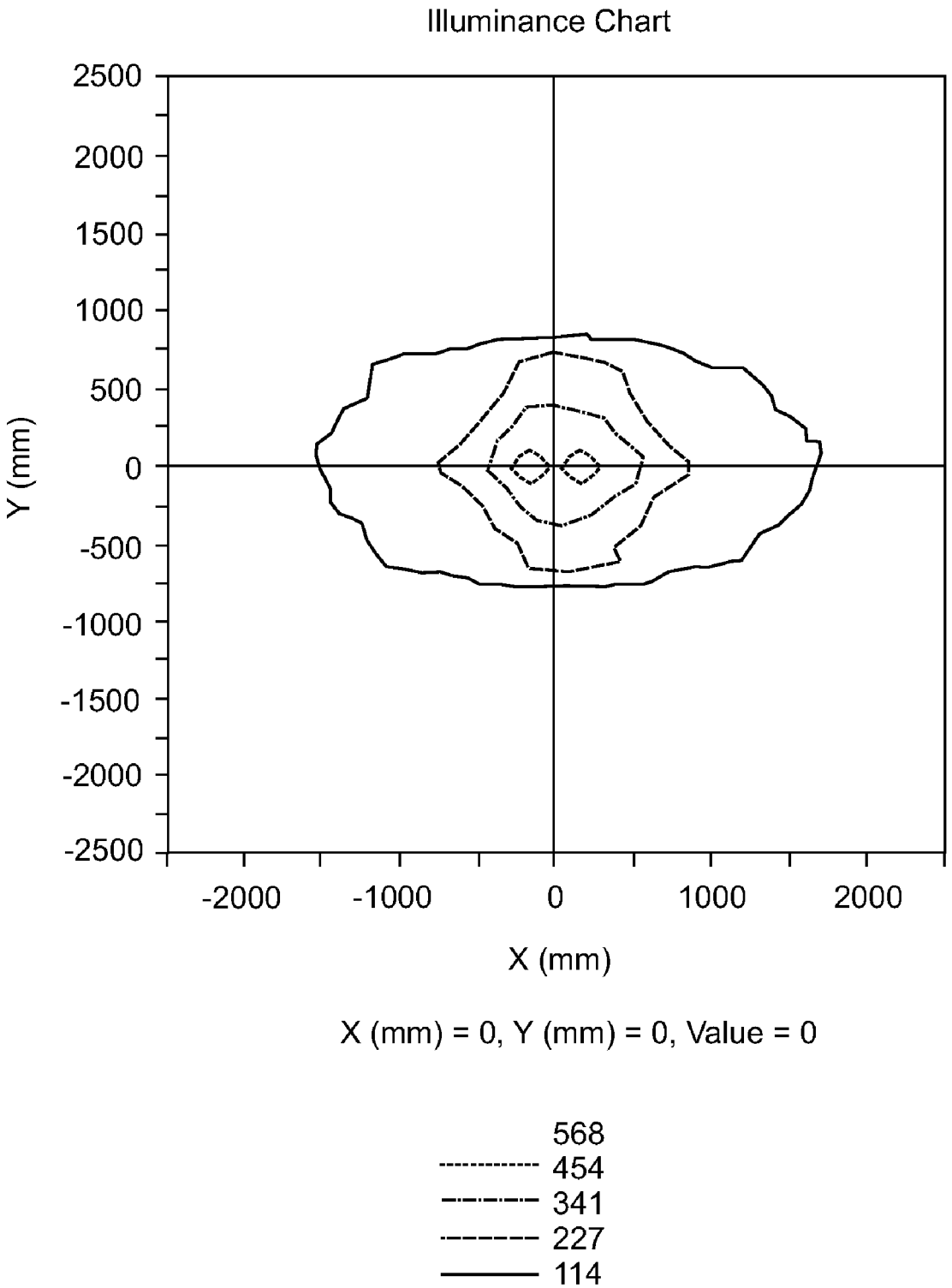
FIG. 7 is an equal illumination intensity profile of a lamp with a lateral reflector array according to an embodiment.

FIG. 7 is an equal illumination intensity profile formed with the lamp shown in FIG. 6. X and Y represent the horizontal coordinate and vertical coordinate of the illuminated area respectively. The values with the same illumination intensity are connected with curves, and different line types represent different values of the illumination intensity. The values of the illumination intensity are indicated on the right side of the line types. It can be seen from the diagram that the values of the illumination intensity are relatively homogeneously distributed in the center, and an essentially rectangular light spot is obtained.

Figure 8:
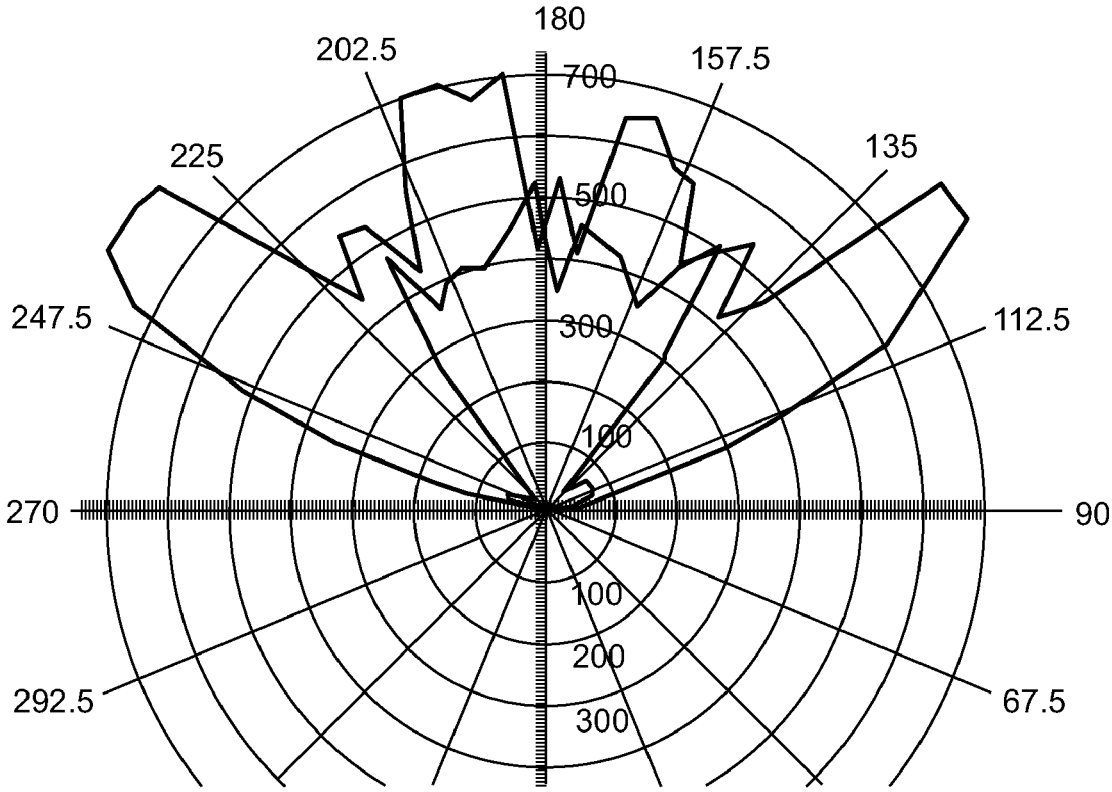
FIG. 8 is a polar coordinate profile of the light intensity of a lamp with a lateral reflector array according to an embodiment.

FIG. 8 is a polar coordinate profile formed with the lamp shown in FIG. 6. The angle coordinates in the diagram represent the angle distribution in a space, wherein the unit is Degree. The radius length of a circle represents a light intensity with the unit of Candela. The outer curve enclosing a larger area represents the light intensity distribution curve in the direction of the long side of the rectangle. For example, in the case of a street lamp application, it represents the light intensity distribution curve along the street. The other curve represents a light intensity distribution curve in the direction perpendicular to the long side of the rectangle. It can also be seen from the diagram that the values of the illumination intensity are relatively homogeneously distributed in the center of the rectangle.

Figure 9:
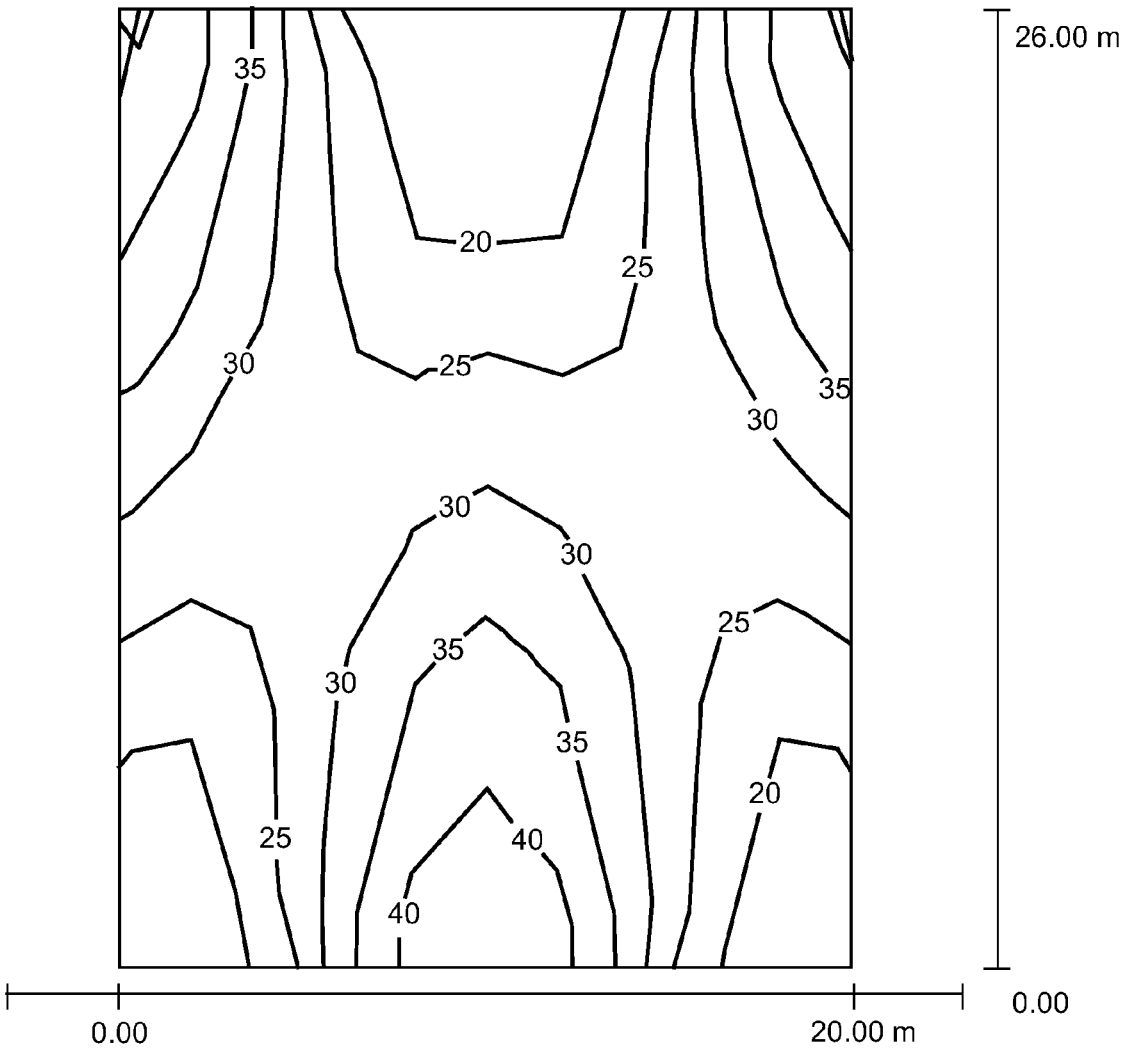
FIG. 9 is an illumination intensity profile when the lamp with the lateral reflector array according to an embodiment is applied in a street illumination.

FIG. 9 is a street illumination intensity profile when the lamp according to various embodiments is applied in an LED street lamp project. In this diagram, the 26 m on the right side indicates the width of a street, and the 20 m on the bottom indicates the distance between the street lamps. The height of the lamp from the street is 8 m. This diagram is obtained by connecting the values with the same illumination intensity with a curve, and marking the values of the illumination intensity (in Lux) on the curves. It can be seen from the diagram that the illumination intensity is relatively homogeneously distributed in the simulated street illumination, and a good optical performance is obtained.

Further, according to an embodiment, it is presented a method for producing the lateral reflector, including: arranging a reflecting surface on opposite sides of a light source respectively, wherein the reflecting surface is configured to reflect a light emitted from the light source and arriving at the reflecting surface, so that the light arriving at the reflecting surface is deflected toward a direction that is parallel to the opposite sides.

Finally, it should be noted that the term "include", "comprise" or any other variations means a non-exclusive inclusion, so that the process, method, article or device that includes a series of elements includes not only these elements but also other elements that are not explicitly listed, or further includes inherent elements of the process, method, article or device. Moreover, when there is no further limitation, the element defined by the wording "include(s) a . . . " does not exclude the case that in the process, method, article or device that includes the element there are other same elements.

The various embodiments are described in detail in combination with drawings. However, it should be understood that the embodiments described above are only used for illustrating the invention, and do not constitute a limitation of the invention. Various modifications and variations may be made to the above embodiments by those skilled in the art, without departing from the essential and scope of the present invention. Therefore, the scope of the present invention is only defined by the appended claims and the equivalent meanings thereof.

The invention claimed is:

1. A lateral reflector, comprising:

a bottom opening, a light source arranged on a base plate can be accommodated in the bottom opening;

a reflecting surface, which is arranged respectively on two opposite sides of the light source in the lateral reflector, and the reflecting surface is configured to reflect a light emitted from the light source and arriving at the reflecting surface, so that the light arriving at the reflecting surface is deflected toward a direction that is parallel to the opposite sides wherein a portion is truncated on a top of the reflecting surface, so as to avoid a shadow appearing on a surface to be illuminated due to a shading of the reflecting surface.

2. The lateral reflector according to claim 1, wherein the reflecting surface is a plane or a free-form surface.

3. The lateral reflector according to claim 1, wherein the reflecting surface is a smooth surface or a surface with microstructures.

4. The lateral reflector according to claim 1, wherein the reflecting surface is formed with a material having a high reflectivity.

5. The lateral reflector according to claim 1, wherein the reflecting surface is made of metal or plastic cement.

6. A lateral reflector array, which is an array made up of a plurality of lateral reflectors, wherein at least one lateral reflector of the plurality of lateral reflectors comprises: a bottom opening, a light source arranged on a base plate can be accommodated in the bottom opening; a reflecting surface, which is arranged respectively on two opposite sides of the light source in the lateral reflector, and the reflecting surface is configured to reflect a light emitted from the light source and arriving at the reflecting surface, so that the light arriving at the reflecting surface is deflected toward a direction that is parallel to the opposite sides.

7. The lateral reflector array according to claim 6, wherein the array is a rectangular array.

8. A lamp unit, comprising:

a base plate, a light source arranged on the base plate, and a lateral reflector, which comprises:

a bottom opening, a light source arranged on a base plate can be accommodated in the bottom opening;

a reflecting surface, which is arranged respectively on two opposite sides of the light source in the lateral reflector, and the reflecting surface is configured to reflect a light emitted from the light source and arriving at the reflecting surface, so that the light arriving at the reflecting surface is deflected toward a direction that is parallel to the opposite sides;

wherein the lateral reflector is configured so that the light source on the base plate is accommodated in a bottom opening of the lateral reflector wherein a portion is truncated on a top of the reflecting surface, so as to avoid a shadow appearing on a surface to be illuminated due to a shading of the reflecting surface.

9. A lamp, comprising a plurality of lamp units, wherein at least one lamp unit of the plurality of lamp units comprises a base plate, a light source arranged on the base plate, and a lateral reflector, which comprises:

a bottom opening, a light source arranged on a base plate can be accommodated in the bottom opening;

a reflecting surface, which is arranged respectively on two opposite sides of the light source in the lateral reflector, and the reflecting surface is configured to reflect a light emitted from the light source and arriving at the reflecting surface, so that the light arriving at the reflecting surface is deflected toward a direction that is parallel to the opposite sides;

wherein the lateral reflector is configured so that the light source on the base plate is accommodated in a bottom opening of the lateral reflector, wherein the plurality of lamp units are arranged in an array.

10. The lamp according to claim 9, wherein the array of the lamp units is arranged as a rectangle.

11. A method for producing a lateral reflector, the lateral reflector comprising:

a bottom opening, a light source arranged on a base plate can be accommodated in the bottom opening;

a reflecting surface, which is arranged respectively on two opposite sides of the light source in the lateral reflector, and the reflecting surface is configured to reflect a light emitted from the light source and arriving at the reflecting surface, so that the light arriving at the reflecting surface is deflected toward a direction that is parallel to the opposite sides;

the method comprising: arranging a reflecting surface on opposite sides of a light source respectively, wherein the reflecting surface is configured to reflect a light emitted from the light source and arriving at the reflecting surface, so that the light arriving at the reflecting surface is deflected toward a direction that is parallel to the opposite sides wherein a portion is truncated on a top of the reflecting surface, so as to avoid a shadow appearing on a surface to be illuminated due to a shading of the reflecting surface.

* * * * *